US005184273A

United States Patent [19]

Tanaka et al.

[11] Patent Number: 5,184,273

[45] Date of Patent: Feb. 2, 1993

[54] MICROGAP TYPE SURGE ABSORBER

[75] Inventors: Yoshiyuki Tanaka; Takaaki Itoh, both of Saitama, Japan

[73] Assignee: Mitsubishi Materials Corporation, Tokyo, Japan

[21] Appl. No.: 798,528

[22] Filed: Nov. 26, 1991

[30] Foreign Application Priority Data

Nov. 27, 1990 [JP] Japan ..... 2-320898

[51] Int. Cl.[5] ..... H01H 9/04; H01H 9/06

[52] U.S. Cl. ..... 361/120; 337/34; 361/118

[58] Field of Search ..... 361/120, 118, 117, 119, 361/123; 337/32, 34, 28

[56] References Cited

U.S. PATENT DOCUMENTS 4,317,155 2/1982 Harada et al. ..... 361/120

4,433,354 2/1984 Lange et al. ..... 361/129

*Primary Examiner*—Harold Broome

*Attorney, Agent, or Firm*—McAulay Fisher Nissen Goldberg & Kiel

[57] ABSTRACT

A microgap type surge absorber comprises a columnar insulator element being covered with a conductive material and provided with a microgap around the center thereof, a pair of conductive caps being fixed on the both ends of the element, first and second electrodes being attached to the both caps, first and second glass tubes adhering to the periphery of the first and second electrodes and surrounding the end parts of the element, and a cylindrical third electrode being held between the both glass tubes and adjacently surrounding the element containing the microgap. The first, second, and third electrodes and glass tubes are charged with inert gas. When a glow discharge started from near the microgap extends to the conductive coating and arrives at the caps, an arc discharge is formed between caps through the third electrode. The third electrode protects the microgap from arc discharge current.

7 Claims, 3 Drawing Sheets

MICROGAP TYPE SURGE ABSORBER

BACKGROUND OF THE INVENTION

1. Field of the Invention

This invention relates to a microgap type surge absorber, and more particularly to a microgap type surge absorber having an improved durability to repeated surge applications or a large current surge application.

2. Description of the Related Art

Surge absorbers are used to protect devices connected to communication lines, such as, telephone lines, telecopier lines, and the like, from electrical surges.

FIG. 4 shows a conventional surge absorber comprising a columnar or rod-shaped insulator element 1, the surface of which is coated with a conductive material having a microgap 2 in the coating of the center of the element 1, cap electrodes 3*a* and 3*b* at each end of the element 1, each having a lead wire attached thereto. The entire assembly is encased in a sealed glass tube 5 which is charged with an inert gas 4, except that the distal portion of the lead wires extend exterior of the glass tube to provide electrical connection means.

When a voltage above the discharge starting voltage of the microgap is applied to such a conventional surge absorber, a glow discharge immediately starts from near the microgap. This glow discharge is conveyed to both cap electrodes, and then an arc discharge is formed between the cap electrodes through or near the microgap to thereby absorb the applied surge.

If repeated surge applications or a large current surge application is applied to such a conventional surge absorber, the microgap of the surge absorber may be damaged by the heat thereof. Accordingly, a problem with the conventional surge absorber is that the surge absorbing performance is degraded due to the damage to the microgap caused by the repeated arc discharges or the large arc discharge, and its lifetime is shortened.

Japanese Unexamined Published Patent Application Sho 63-205026 discloses such a conventional surge absorber.

SUMMARY OF THE INVENTION

It is an object of this invention to provide a microgap type surge absorber having a construction wherein the arc discharge is not formed near the microgap.

It is another object of this invention to provide a microgap type surge absorber having a long lifetime, in which the absorbing performance is not degraded by repeated surge applications or a large current application. The inventive microgap type surge absorber is characterized in that a cylindrical third electrode is formed in a microgap type surge absorber to conduct arc discharge current passing through or near the microgap and thereby protect the microgap from arc discharge current.

More particularly, the inventive surge protector is composed of a sealed chamber having a rod-shaped element therein formed from an electrically insulating material. The element has a coating thereon of an electrically conducting material which has a microgap therein about the periphery of the rod and centered between the ends of the element. First and second electrodes are located at each end of the element in electrically conductive contact with the coating. Electrically conductive members are connected to the electrodes which extend exterior of the chamber for connection with an electric source. A third hollow cylindrical electrode is located within the chamber and has a diameter larger than the width of the rod-shaped element and a length greater than the width of the microgap. The rod-shaped element is aligned within the hollow portion of the third electrode along its cylindrical axis and is spaced apart from the interior surface of the third electrode. As a result, current near the microgap is discharged away from it to the third electrode, thereby providing protection for the microgap. These and other objects of this invention will be better understood and will become more apparent with reference to the following detailed description considered in connection with the accompanying drawings.

DETAILED DESCRIPTION OF THE INVENTION

Figure 1:
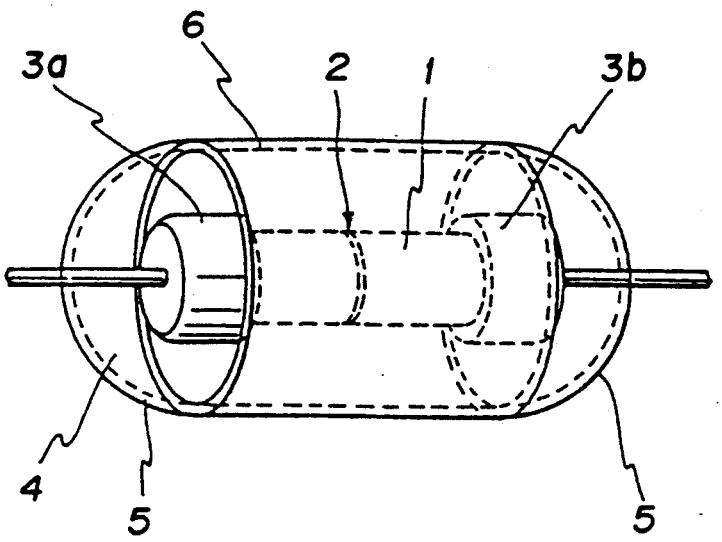
FIG. 1 is a schematic partly perspective view showing the construction of an inventive surge absorber.
Figure 4:
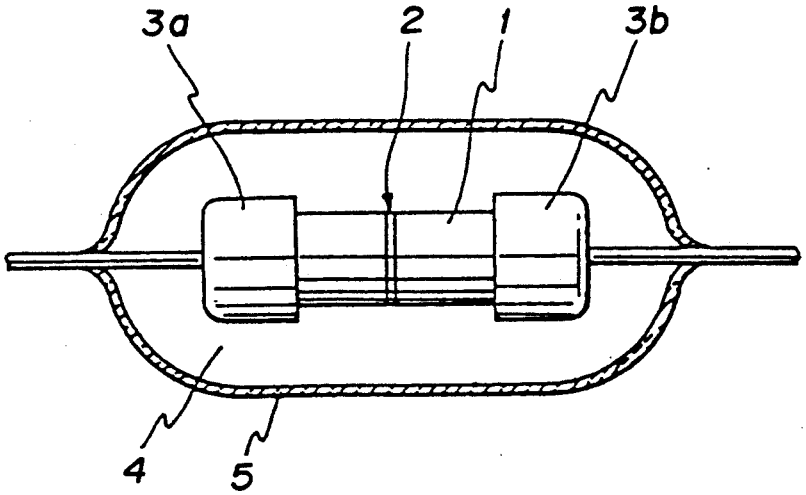
FIG. 4 (PRIOR ART)
FIG. 4 is a sectional view showing the construction of a conventional surge absorber.

As shown in FIG. 1, a cylindrical third electrode 6 is set between glass tube ends 5 which are formed by dividing a sealed glass tube.

By holding the cylindrical third electrode 6 between the glass tube ends 5, the arc discharge is finally formed between cap electrodes 3*a* and 3*b* through the third electrode 6.

Accordingly, a glow discharge starting from near the microgap 2 extends along conductive coating 1, to cap electrodes 3*a* and 3*b*, and then an arc discharge is formed between cap electrodes 3*a* and 3*b* through the third electrode 6.

Since the arc discharge current goes through the third electrode 6, away from the microgap, the conductive coating near the microgap 2 is not affected or damaged by the heat of the arc discharge current. Therefore, the microgap of the inventive surge absorber has a longer lifetime than that of the conventional surge absorber, and can also endure a larger arc discharge.

For the above reason, the inventive microgap type surge absorber has an improved durability to repeated surges or a large current surge.

The surge absorber of this invention can also be used for protecting various power lines from repeated surges or a large current surge.

EXAMPLE 1

Figure 2:
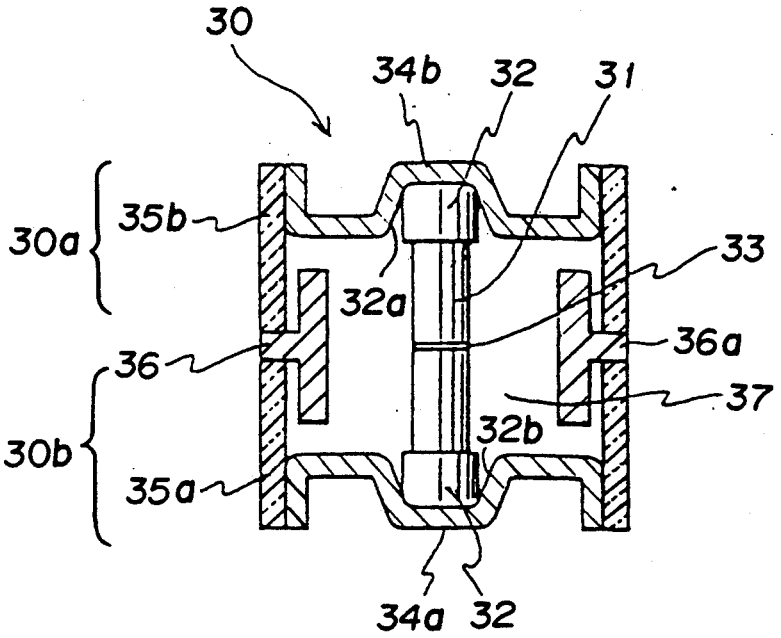
FIG. 2(A) is a sectional view of a preferred embodiment of this invention, along the line 2A'—2A' of FIG. 2(B).
FIG. 2(B) is a perspective view of the preferred embodiment shown in FIG. 2(A).
Figure 2:
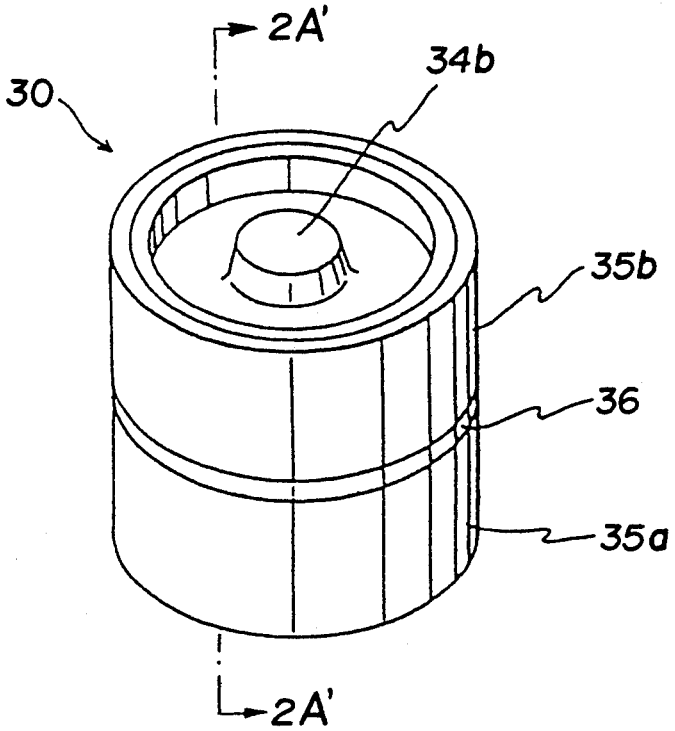

As shown in FIGS. 2(A) and 2(B), the inventive surge protector has cap electrodes 32 which have an inner diameter of 1.68 mm, and an outer diameter of 2.10 mm, forced into both ends of a columnar or cylindrical insulator having a diameter of 1.7 mm and a length of 5.5 mm, coated with a conductive coating 31. A microgap 33 having a width of 30 μm was formed on the center of the conductive coating 31 by using a laser processing machine, so as to provide a complete separation between the two coated areas of the columnar element.

This columnar element is then encapsulated or encased in a closed container 30, which forms essentially the exterior of the casing of the inventive surge protector. This is achieved by combining three elements, namely, circular end pieces 34*a* and 34*b*, glass tubes 35*a* and 35*b*, and a third cylindrical electrode 36.

The third cylindrical electrode 36 has a continuous rectangular-shaped flange 36*a* about its exterior surface, the flange being located midway between the ends of the third electrode, thus giving it a T-shaped cross section. The flange has a thickness of 0.4 mm. The third electrode 36 is made of Kovar and has an outer diameter of 11.3 mm, an inner diameter of 4 mm, and a thickness of 1.5 mm. Kovar is an alloy composed of 54 weight percent iron, 29 weight percent nickel and 17 weight percent cobalt.

Cylindrical glass tubes 35*a* and 35*b* have an inner diameter of 10.0 mm, an outer diameter of 11.3 mm and a length of 3.0 mm. The circular end pieces 34*a* and 34*b* are made of Kovar and have an inner diameter of 2.2 mm. and an outer diameter of 10.0 mm. Each end piece has a centrally disposed pocket for receiving the conductive caps 32 and an outer radial surface width of 2 mm.

The surge protector is put together by first forming assemblies 30*a* and 30*b*, each composed of a glass cylinder having an end piece inserted therein. The end pieces 34*a* and 34*b* have their entire outer surfaces contacting the inner surface of the respective glass tube so the contact surface is 2 mm. The columnar element and the third electrode are then sandwiched between and within assemblies 30*a* and 30*b* such that the ends 32 of the columnar element are each positioned in the recesses 32*a* and 32*b* and the edges of the cylindrical glass tubes 35*a* and 35*b* are placed against opposing sides of flange 36*a*. As a result, the columnar element and the third electrode are secured with the chamber being formed by the combination of end pieces 34*a* and 34*b*, glass tubes 35*a* and 35*b* and the exterior of third element 36. The interior of the chamber thus formed is charged with argon gas and the entire assembly is heat sealed.

The surge durability of the thus obtained microgap surge absorber was measured by using a current surge of 8×20 μ.sec shown in JEC-212 (Standard of the Japanese Electrotechnical Committee).

Two conventional microgap type surge absorbers were also measured by the same method as comparable examples and the results are shown in Table 1. As can be observed from Table 1, while two conventional microgap surge absorbers have a surge durability of about 3000 A, the inventive microgap surge absorber has an excellent surge durability of 10,000 A.

EXAMPLE 2

Figure 3:
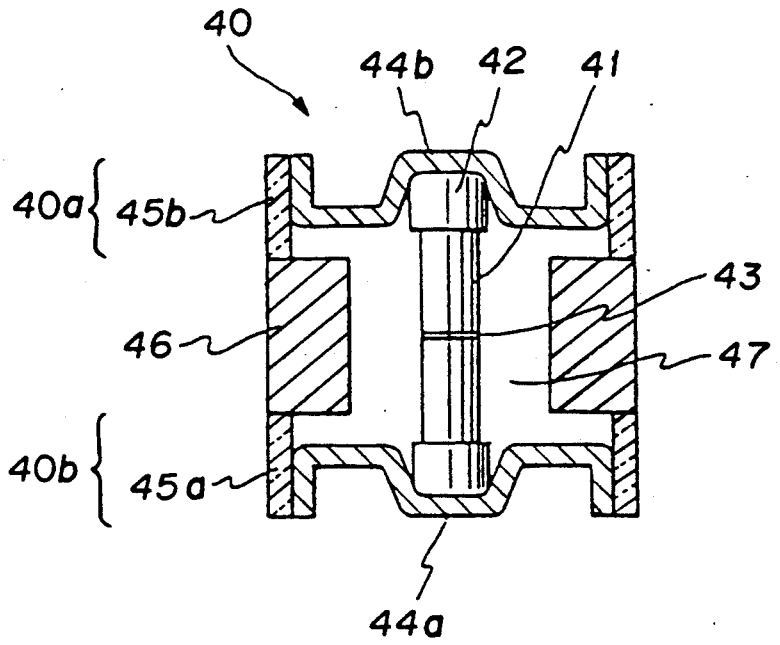
FIG. 3(A) is a sectional view of another preferred embodiment of this invention along the line 3A'—3A' of FIG. 3(B).
FIG. 3(B) is a perspective view of another preferred embodiment shown in FIG. 3(A).
Figure 3:
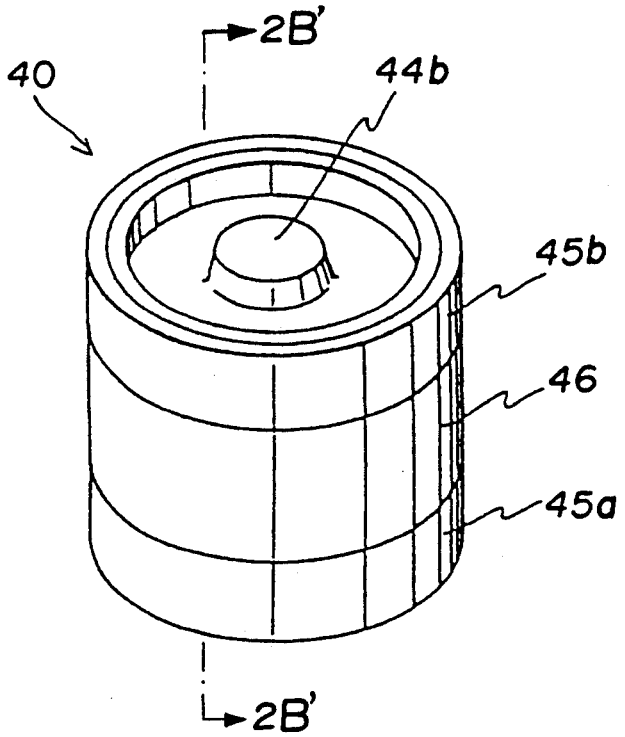

FIGS. 3(A) and 3(B), show another embodiment of the invention. In this embodiment, cap electrodes 42 were forced into both ends of a columnar or cylindrical insulator having a diameter of 1.7 mm and a length of 5.5 mm, coated with a conductive coating 41. A microgap 43 having a width of 30 μm was formed on the center of the conductive coating 41 by using a laser processing machine to obtain a columnar element.

This columnar element is then encapsulated or encased in a closed container 40, which forms essentially the exterior of the casing of the inventive surge protector. This is achieved by combining three elements, namely, circular end pieces 44*a* and 44*b*, glass tubes 45*a* and 45*b*, and a third cylindrical electrode 46.

The third cylindrical electrode 46 has a rectangular cross-section and is made of Kovar. Cylindrical glass tubes 45*a* and 45*b* have an inner diameter of 10.0 mm, an outer diameter of 11.3 mm and a length of 3.0 mm. The circular end pieces 44*a* and 44*b* are made of Kovar and have an inner diameter of 2.2 mm and an outer diameter of 10.0 mm. Each end piece has a centrally disposed pocket for receiving the conductive caps 42 and an outer radial surface width of 2 mm.

The surge protector is put together by first forming assemblies 40*a* and 40*b*, each composed of a glass cylinder having an end piece inserted therein. The end pieces 44*a* and 44*b* have their entire outer surfaces contacting the inner surface of the respective glass tube so the contact surface is 2 mm. The columnar element and the third electrode are then sandwiched between and within assemblies 41*a* and 41*b*, such that the ends 42 of the columnar element are each positioned in the recesses 42*a* and 42*b* and the edges of the cylindrical glass tubes 45*a* and 45*b* are placed against opposing sides of third electrode 46. As a result, the columnar element and the third electrode are secured with the chamber being formed by combination of end pieces 44*a* and 44*b*, glass tubes 45*a* and 45*b* and the exterior of the third element 46. The interior of the chamber thus formed is charged with argon gas and the entire assembly is heat sealed to obtain the inventive microgap surge absorber.

The surge durability of the thus obtained microgap surge absorber was measured by using a current surge of 8×20 μ.sec shown in JEC-212.

Two conventional microgap type surge absorbers were also measured by the same method as comparable examples.

The results are also shown in Table 1.

As can be observed from Table 1, while the two conventional microgap surge absorbers have a surge durability of about 3000 A, the inventive microgap surge absorber has an excellent surge durability of 10,000 A.

TABLE 1

| | CONVENTIONAL SURGE ABSORBER A | CONVENTIONAL SURGE ABSORBER B | INVENTIVE SURGE ABSORBER EXAMPLE 1 | INVENTIVE SURGE ABSORBER EXAMPLE 2 |
|---|---|---|---|---|
| insulator body | mullite | mullite | mullite | mullite |
| coating material | TiN | TiN | TiN | TiN |
| diameter of lead wire (mm) | 0.4 | 0.6 | — | — |
| diameter of insulator element (mm) | 6.0 | 6.0 | 11.3 | 11.3 |
| length of insulator element (mm) | 21.0 | 21.0 | 6.4 | 6.4 |

TABLE 1-continued

| | CONVENTIONAL SURGE ABSORBER A | CONVENTIONAL SURGE ABSORBER B | INVENTIVE SURGE ABSORBER EXAMPLE 1 | INVENTIVE SURGE ABSORBER EXAMPLE 2 |
|---|---|---|---|---|
| surge durability (A) | 1500 | 3000 | 10,000 | 10,000 |
| discharge starting voltage (V) | 300 | 300 | 300 | 300 |

What is claimed is:

1. A microgap surge protector which comprises:

a) a wall forming a sealed chamber;

b) a rod-shaped element within the chamber formed from an electrically insulating material, said element having:

a coating thereon of an electrically conducting material, said coating having a microgap therein centered between the ends of the element;

first and second electrodes, one at each end of the element in electrically conductive contact with the coating;

(c) means for providing an electrical connection between the exterior of the chamber and the first and second electrodes;

d) a third cylindrical electrode having a hollow portion therein within the chamber and having a diameter larger than the rod-shaped element and a length greater than the width of the microgap, the rod-shaped element being aligned within the hollow portion and coaxially with the third electrode such that it is spaced apart from the interior surface of the third electrode and the microgap is positioned between the ends of the third electrode;

e) an inert gas filling the interior of the chamber.

2. The surge protector of claim 1 wherein the chamber is formed from a cylindrical glass tube having sealed ends.

3. The surge protector of claim 1 wherein the chamber comprises:

first and second pieces of cut glass tubes, a conductive end piece at one end of each tube to seal the end of each tube, a center piece composed of the cylindrical third, electrode, the cylindrical electrode being sandwiched between the unsealed ends of the glass tubes, the tubes and third electrode being sealed together, the end pieces, glass tubes, and at least a portion of the third electrode forming the wall of the chamber.

4. The surge protector of claim 1 wherein the first, second and third electrodes are made from a fernico alloy composed of 54 wt. % iron, 29 wt. % nickel, and 17 wt. % cobalt.

5. The surge protector of claim 2 wherein the end pieces are made from a fernico alloy composed of 54 wt. % iron, 29 wt. % nickel, and 17 wt. % cobalt.

6. The surge protector of claim 1 wherein the inert gas is argon.

7. The surge protector of claim 1 wherein the insulating material is mullite.

* * * * *